US006449980B1

(12) United States Patent
Minister

(10) Patent No.: US 6,449,980 B1
(45) Date of Patent: Sep. 17, 2002

(54) REFRIGERATION SYSTEMS

(75) Inventor: David John Minister, Maldon (GB)

(73) Assignee: NBS Cryo Research Limited, Hertfordshire (GB)

( * ) Notice: Subject to any disclaimer, the term of this patent is extended or adjusted under 35 U.S.C. 154(b) by 0 days.

(21) Appl. No.: 09/943,534

(22) Filed: Aug. 30, 2001

(30) Foreign Application Priority Data

Aug. 31, 2000 (GB) ..... 0021335

(51) Int. Cl.[7] ..... F25B 41/00
(52) U.S. Cl. ..... 62/513; 62/503; 62/472
(58) Field of Search ..... 62/503, 510, 513, 62/113, 115, 137, 148, 190, 472

(56) References Cited

U.S. PATENT DOCUMENTS 3,950,961 A * 4/1976 Lotz ..... 62/149
5,366,150 A * 11/1994 Kaimoto et al. ..... 237/2 A
5,714,738 A * 2/1998 Hauschulz et al. ..... 219/535

* cited by examiner

*Primary Examiner*—William C. Doerrler
*Assistant Examiner*—Melvin Jones
(74) *Attorney, Agent, or Firm*—Renner, Kenner, Greive, Bobak, Taylor & Weber

(57) ABSTRACT

A refrigeration system which comprises a compressor, an evaporator to which liquid refrigerant compressed by the compressor is supplied through a flow restrictor, and return means which direct refrigerant expanded in the evaporator back to the compressor. The return means include an accumulator in which liquid refrigerant leaving said evaporator may collect, and heating means either integral with or attached to the accumulator. The heating means are adapted to supply heat energy to the liquid refrigerant collected by said accumulator in order to promote its evaporation, thereby increasing the overall efficiency of the refrigeration system. The heating means may be controlled by a microprocessor.

13 Claims, 1 Drawing Sheet

REFRIGERATION SYSTEMS

FIELD OF INVENTION

The present invention relates to refrigeration systems, and particularly (but not exclusively) to refrigeration systems for ultra-low temperature storage compartments.

BACKGROUND OF INVENTION

The operation of conventional low temperature refrigeration systems is well known in the art, so will not be described in detail here. However to appreciate the benefits provided by the present invention it is necessary briefly to explain how such conventional systems work.

A basic refrigeration system comprises a compressor which compresses gaseous refrigerant and supplies it to a heat exchanger where the refrigerant is condensed to a liquid, giving out heat energy. This liquid refrigerant then passes through a flow restrictor into an evaporator whereat the low pressure and the expansion of the refrigerant causes the refrigerant to vaporise thereby absorbing heat. The gaseous refrigerant then passes out of the evaporator back to the compressor to begin the cycle again. An accumulator is usually provided in the return path between the evaporator and the compressor, and the accumulator collects any liquid vapour passing through the evaporator so as to prevent its entry into the compressor.

Systems intended to cool to lower temperatures often employ a dual-stage cascade system which essentially comprises two separate but co-operating refrigeration systems. One of these stages draws heat from the location to be cooled; this stage is generally termed the low-side because it operates. at a lower average temperature. The other stage is adapted to cool the compressed low-side refrigerant and release the heat to the external environment. As this second stage operates at a higher average temperature it is generally termed the high-side.

Refrigeration systems, including dual stage systems, seldom operate continuously, but instead switch as appropriate between an on-time and an off-time so as to maintain the desired temperature. This on/off switching aims to make the operation of the refrigeration system as efficient as possible, and is usually controlled thermostatically.

Many refrigeration systems, and particularly low temperature dual-stage ones, use a capillary tube as the flow restrictor (also called a metering device), and whilst such systems have many advantages, they are still far from totally efficient. The main cause of this lack of efficiency is the unnecessary time of operation when in an on-condition.

When a refrigeration system shuts off, gaseous refrigerant will condense within the evaporator, and this refrigerant will collect in the accumulator. During normal operation liquid refrigerant that has not been fully vaporized is stored in the accumulator, particularly at the end of the cycle as the load on the evaporator decreases. When a capillary tube is employed as a metering device liquid refrigerant continues to flow through the evaporator during the off cycle until the system pressure balances. If an accumulator is effectively to protect the compressor by preventing liquid refrigerant from entering it at the start of an on-time, the accumulator needs to be able to hold all of the charge of refrigerant that passes through the evaporator in the off-time. Unfortunately, when the system starts an on-time, it takes a while for the liquid refrigerant in the accumulator to vaporise and return to the compressor. When the compressor starts, the slow rate of evaporation causes the pressure at the input to the compressor to drop to a low level until a sufficient amount of vapour is available for compression, to be passed round the system. This low pressure at the start of a period of operation drastically reduces the volumetric efficiency of the compressor and prolongs the on-time.

In essence the compressor, which consumes the most energy in the cycle, operates at the beginning of an on-time at a lower efficiency. The efficiency (i.e. the amount of cooling achieved per unit of energy input) of the compressor increases up to an optimum as the on-time continues, but the delay in reaching this optimum efficiency can cause the on-time to be unnecessarily prolonged.

SUMMARY OF INVENTION

Therefore, according to the present invention there is provided a refrigeration system comprising a compressor, an evaporator to which refrigerant compressed by the compressor is supplied through a flow restrictor, and return means to direct back to the compressor refrigerant expanded in the evaporator, in which system the return means includes an accumulator in which may collect any liquid refrigerant leaving the evaporator, the accumulator being provided with heating means to evaporate liquid refrigerant collected by the accumulator.

In use the heating means provides sufficient heat to the liquid refrigerant in the accumulator to cause at least partial vaporisation thereof. Heating the accumulator causes the liquid refrigerant to vaporise more rapidly and at a higher pressure. This gaseous refrigerant then can return to the compressor to pass round the cycle. By encouraging the liquid refrigerant in the accumulator to vaporise, the time taken for the compressor to achieve optimum efficiency is dramatically reduced, and in consequence the length of any on-time may be significantly shortened. Tests have shown a 40%–50% reduction in the average duration of on-times.

If the accumulator were to be heated continuously the pressure would remain high, thus inhibiting the operation of the evaporator. Therefore it is highly preferred that there is provided a controller for the heating means, which controller is arranged to cause the heating means to operate for an interval at the commencement of a period of refrigeration following a period of inactivity of the system.

The duration of the heating interval may preferably be between 2 and 6 minutes, with 3–4 minutes being even more preferred. The control of the duration of the heating interval is dependent on a number of factors, such as the temperature of the refrigerant.

This system is primarily intended for use in an electrically powered refrigeration system. As such the heating means may be electrically powered. The heating means may be integrally formed with the accumulator, or may be a separate unit applied to the outside thereof. If applied separately, the heating means may be in the form of a flexible electric heating pad placed against a portion, preferably at least a lower portion, of the accumulator. Alternatively the heating means could utilise hot gas from other parts of the high or low side, flow of which could be controlled by a solenoid valve.

To ensure accurate and reliable control of the refrigeration system, the controller may comprise or include a microprocessor adapted to operate the heating means. The controller may operate in response to data pre-stored therein. In addition, or instead, the controller may operate in response to data received from external sources such as a pressure sensor, temperature sensors or other control equipment.

The present invention is applicable to various refrigeration systems, but will find a particular application to low temperature dual-stage systems. In such systems the heating means could be applied to both an accumulator on the low-side and an accumulator on the high-side. In practice, testing so far has shown that application of heating means to a high-side accumulator provides little if any increase in efficiency; thus, for reasons of economy, the heater may be provided on the low-side accumulator only.

It is normal for a conventional refrigeration system to include some form of control means, even if it is as simple as a thermostatic switch linked to the power supply. For reasons of simplicity and overall efficiency, the controller may be integrated in, or part of, an overall system controller.

In addition to the advantages discussed above, the present invention offers at least two further advantages. Firstly if the heater should fail, the system can still continued to operate as an existing system thereby not increasing the risk of damage to the goods stored in a freezer using such a refrigeration system. In effect it is fail-safe. Secondly, use of the present invention simplifies the task of charging the system with refrigerant during manufacture. In existing systems, the amount of refrigerant introduced into the system has to be carefully controlled. Too little refrigerant causes poor performance, but if too much is contained, not only can performance suffer, but more importantly refrigerant condensing during the off-time can overflow the condenser and flood the compressor. In systems according to the present invention larger capacity accumulators may be used without sacrificing performance, as would be the case in existing systems. Therefore, a greater degree of variation in the amount of refrigerant introduced can be tolerated and the process of manufacture simplified.

According to the present invention, there is also provided a low-temperature storage compartment, such as a freezer, incorporating a refrigeration system as hereinbefore described.

BRIEF DESCRIPTION OF DRAWING

By way of example only and in order that the present invention may be better understood one embodiment thereof will now be described in detail, with reference to the accompanying drawings in which.

DESCRIPTION OF PREFERRED EMBODIMENTS

Figure 1:
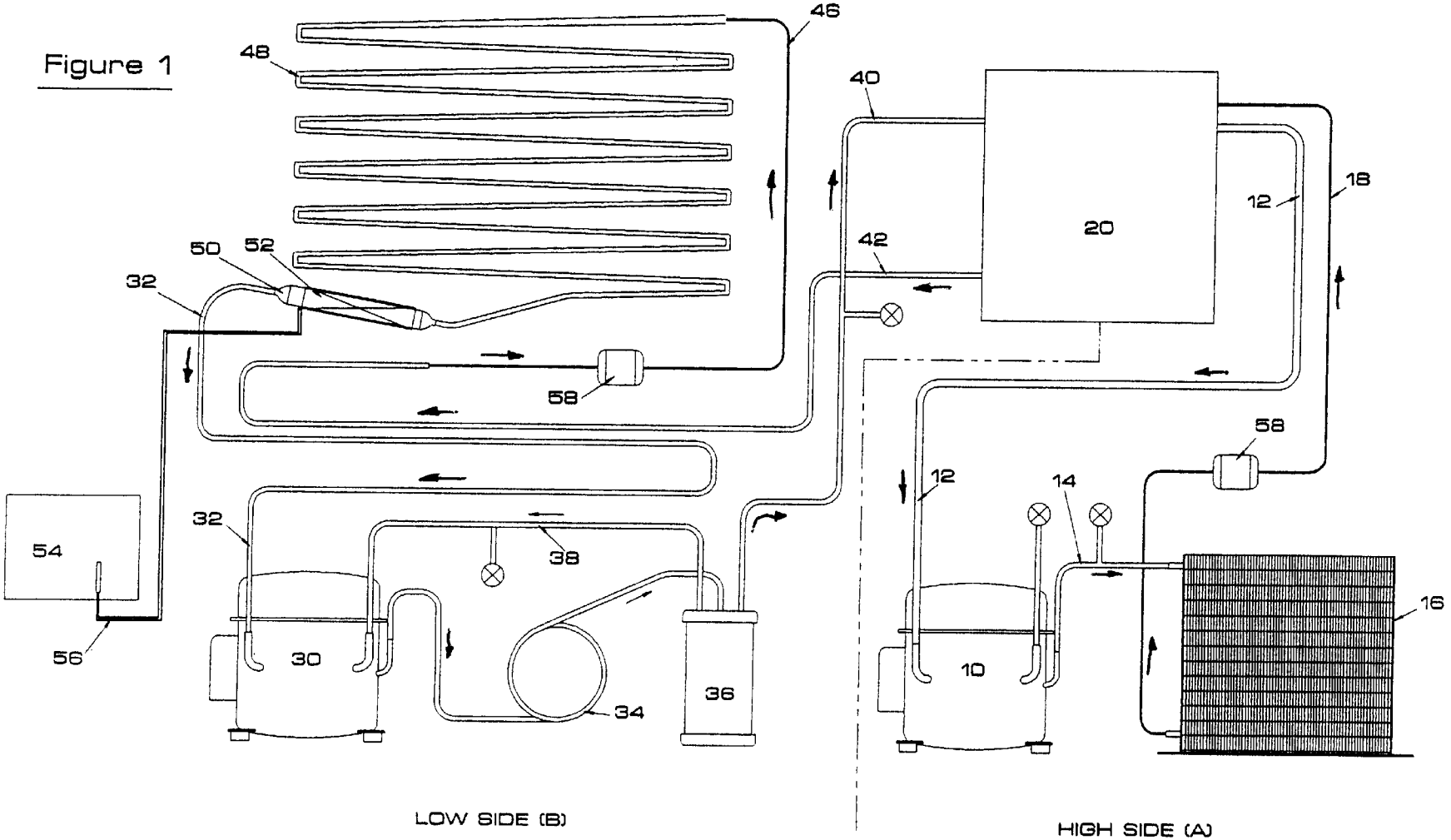
FIG. 1 shows a schematic diagram of one embodiment of a dual stage refrigeration system according to the present invention.

The refrigeration system shown in FIG. 1 has two discrete cycles; one generally termed the high-side (labelled A), and the other generally termed the low-side (labelled B). During periods of on-time in normal operation, the low-side draws heat from the area to be cooled, and the high-side is adapted to cool the refrigerant of the low-side and dissipate that heat to the external environment. Separate refrigerants flow around the two cycles and whilst they thermally interact they do not come into direct contact. The types of refrigerant used are well know in the prior art so will not be discussed in detail. In FIG. 1 the direction of flow is indicated by arrows.

The high-side cycle comprises a compressor 10 which receives gaseous refrigerant from a return pipe 12. The compressor pressurises the gaseous refrigerant and pumps it out through a discharge pipe 14 into the condenser 16. In the condenser, heat energy is dissipated from the condensing refrigerant to the external atmosphere. The thus liquefied refrigerant passes out of the condenser 16 into a flow-restricting capillary pipe 18.

At the heat exchanger assembly 20, liquid high-side refrigerant exits the capillary tube 18 and is allowed to expand. This expansion cause the absorption of heat thereby cooling refrigerant passing round the low-side (herein after termed low-side refrigerant). Gaseous high-side refrigerant then passes back to condenser 10 through a return pipe 12. The high-side and low-side refrigerants are allowed to thermally interact, but do not come into physical contact.

The low-side cycle operates in a broadly similar way. Gaseous refrigerant enter the compressor 30 from a low-side return pipe 32 and is pressurised. Pressurised refrigerant passes out of the compressor 30 to a de-super-heating coil 34, and then to an oil separator 36. In the oil separator 36, any oil picked up during passage of the refrigerant through the compressor is separated and returned to the compressor 30 through oil return pipe 38. The refrigerant subsequently passes along feeder pipe 40 to the heat exchanger assembly 20. In the heat exchanger 20 low-side refrigerant is cooled by the high-side refrigerant. The cooled low-side refrigerant then passes out of heat exchanger unit 20 through a low-side discharge pipe 42.

The refrigerant then passes through a flow restrictor, which in this embodiment is low-side capillary tube 46. The low-side refrigerant passes from the capillary tube 46 into an evaporator 48. In the evaporator 48, at least a major portion of the low-side refrigerant changes state from liquid to gas and absorbs heat from the surrounding area, thereby effecting cooling. Gaseous refrigerant passing out of the evaporator 48 returns to the compressor 30 through the low-side return pipe 32.

Arranged between the discharge end of the evaporator 46 and the return pipe 32 there is provided an accumulator 50. The accumulator is adapted to prevent any liquid refrigerant passing through the evaporator from entering the low-side return pipe 32 and thereby gaining access to the compressor 30. If liquid refrigerant were able to enter the compressor 30, it could cause serious damage. During an off-time, low-side refrigerant will tend to condense within the evaporator 48 and will collect in the accumulator 50. At the beginning of an on-time the low-side refrigerant will vaporise and return to the compressor to start the cycle. As mentioned above the slow rate of vaporisation in prior art systems reduces the efficiency of the system. Therefore in this system the accumulator 50 is provided with a heater 52 disposed therearound. The heater 52 is operated at the beginning of an on-time to increase the rate of vaporisation of the low-side refrigerant in the accumulator 50. A controller 54, possibly including a microprocessor chip, is operatively connected to the heater 52 by a lead 56. The duration of heating is controlled by the controller 54 which may be integrated into an overall system control mechanism (not shown).

Filter dryers 58 are provided both in the high-side capillary tube 18 and the low-side capillary tube 46, and the function of these will be well understood in the art.

I claimed:

1. A dual stage refrigeration system having a low-temperature stage and a high temperature stage, wherein the low-temperature stage comprises, a compressor, an evaporator to which refrigerant compressed by the compressor is supplied through a flow restrictor, and return means to direct back to the compressor refrigerant expanded in the evaporator, in which system said return means include an accumulator in which may collect liquid refrigerant leaving said evaporator, and heating means associated with said accumulator to evaporate liquid refrigerant collected by said accumulator.

2. A dual stage refrigeration system as claimed in claim 1, wherein the heating means is electrically powered.

3. A dual stage refrigeration system as claimed in claim 1, wherein the heating means receives heat energy from refrigerant in other parts of the refrigeration system and at an elevated temperature.

4. A dual stage refrigeration system as claimed in claim 1, wherein the heating means comprises a separate unit mounted externally on the accumulator.

5. A dual stage refrigeration system as claimed in claim 1, wherein the heating means comprises a flexible electric heating pad mounted externally on the accumulator and thermally associated therewith.

6. A dual stage refrigeration system as claimed in claim 1, wherein the heating means is a silicone rubber mat heater.

7. A dual stage refrigeration system as claimed in claim 1, wherein the heating means is integrally formed with the accumulator.

8. A dual stage refrigeration system as claimed in claim 1, wherein a controller for the heating means is provided, said controller being arranged to cause the heating means to operate for a time interval at the commencement of a period of refrigeration following a period of inactivity of the refrigeration system.

9. A dual stage refrigeration system as claimed in claim 8, wherein the controller controls the duration of the interval dependent on at least one of the amount of liquid refrigerant in the accumulator at the commencement of a period of refrigeration, the vapour pressure within the accumulator and the temperature of the refrigerant within the accumulator.

10. A dual stage refrigeration system as claimed in claim 8, wherein said time interval is between 2 and 6 minutes.

11. A dual stage refrigeration system as claimed in claim 8, wherein the controller includes a microprocessor adapted to operate the heating means in response to at least one of data stored in the controller and data received by the controller.

12. A dual stage refrigeration system as claimed in claim 8, wherein the controller is part of a system controller which controls the overall refrigeration system.

13. A low-temperature storage compartment incorporating a dual stage refrigeration system having a low-temperature stage and a high temperature stage, wherein the low-temperature stage comprises a compressor, an evaporator to which refrigerant compressed by the compressor is supplied through a flow restrictor, and return means to direct back to the compressor refrigerant expanded in the evaporator, in which system said return means include an accumulator in which may collect liquid refrigerant leaving said evaporator, and heating means associated with said accumulator to evaporate liquid refrigerant collected by said accumulator.

* * * * *